US006801738B2

(12) United States Patent
Oba et al.

(10) Patent No.: US 6,801,738 B2
(45) Date of Patent: Oct. 5, 2004

(54) IMAGE FORMING APPARATUS HAVING VARIABLE/CONTROLLED TIMING FOR SUCCESSIVE FEEDING OF RECORDING MATERIAL AT IMAGE TRANSFER POSITION

(75) Inventors: Hiroyuki Oba, Suntoh-gun (JP); Junichi Kato, Suntoh-gun (JP); Yasushi Shimizu, Suntoh-gun (JP); Hiroshi Satoh, Mishima (JP); Masahiro Yoshida, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 100 days.

(21) Appl. No.: 10/212,099

(22) Filed: Aug. 6, 2002

(65) Prior Publication Data

US 2003/0113134 A1 Jun. 19, 2003

(30) Foreign Application Priority Data

Aug. 8, 2001 (JP) ..... 2001-240398

(51) Int. Cl.[7] ..... G03G 15/02
(52) U.S. Cl. ..... 399/176; 399/50; 399/174
(58) Field of Search ..... 399/50, 174, 175, 399/176

(56) References Cited

U.S. PATENT DOCUMENTS 5,933,681 A * 8/1999 Suzuki ..... 399/50
6,128,456 A 10/2000 Chigono et al. ..... 399/176
6,173,144 B1 * 1/2001 Hirabayashi et al. ..... 399/174
6,212,346 B1 * 4/2001 Hirabayashi et al. ..... 399/176
6,226,480 B1 * 5/2001 Hirabayashi et al. ..... 399/174
6,434,349 B1 * 8/2002 Shimizu et al. ..... 399/176
6,496,663 B2 * 12/2002 Shimizu et al. ..... 399/50
6,553,199 B2 * 4/2003 Ishiyama et al. ..... 399/174
6,611,669 B2 * 8/2003 Suzuki et al. ..... 399/174

FOREIGN PATENT DOCUMENTS

JP 6-3921 1/1994

* cited by examiner

*Primary Examiner*—Fred Braun
(74) *Attorney, Agent, or Firm*—Fitzpatrick, Cella, Harper & Scinto

(57) ABSTRACT

An image forming apparatus includes an image bearing member; a rotatable charging member, forming a nip with the image bearing member, for electrically charging the image bearing member; developing structure for developing an electrostatic image formed on the image bearing member to form a toner image, the developing structure supplying electroconductive particles to the image bearing member, wherein the electroconductive particles are fed to the nip by the image bearing member; and transferring structure for transferring the toner image onto a recording material at a transfer position. The developing structure feeds the electroconductive particles to a region of the image bearing member which corresponds to a region between a first recording material and a second recording material immediately subsequent to the first recording material, and a time period from passage of a trailing end of the first recording material through the transfer position to arrival of a leading end of the second recording material at a transfer position is longer than a time period required for the charging member to rotate one full-turn.

40 Claims, 6 Drawing Sheets

IMAGE FORMING APPARATUS HAVING VARIABLE/CONTROLLED TIMING FOR SUCCESSIVE FEEDING OF RECORDING MATERIAL AT IMAGE TRANSFER POSITION

FIELD OF THE INVENTION AND RELATED ART

The present invention relates to an image forming apparatus such as an electrophotographic copying machine, a laser beam printer, or the like, the charging means of which for charging an image bearing means such as an electrophotographic photoconductive member, an electrostatically recordable dielectric member, or the like, is such a charging means that employs electrically conductive particles, and in which the electrically conductive particles are supplied from the developing means to the nip portion between the charging member and the image bearing member, by way of the image bearing member.

Conventionally, in an image forming apparatus, for example, an electrophotographic image forming apparatus or an electrostatic recording apparatus, an electrophotographic latent image is formed on an image bearing member such as an electrophotographic photoconductive member, an electrostatically recordable dielectric member, and the like. In order to form the electrophotographic image on the image bearing member, the image bearing member must be uniformly charged. As for a charging apparatus for uniformly charging the image bearing member, a corona type charging apparatus (which is not placed in contact with image bearing member) has been widely used. However, a corona type charging apparatus suffers from a few problems. For example, it generates a large amount of ozone, and in order to charge the image bearing member, it is necessary to apply high voltage, for example, 10 kV, between the charging apparatus and image bearing member, which adds to apparatus cost.

In recent years, the so-called contact charging apparatuses have been devised, and some of them have been put to practical use. In the case of this type of charging apparatus, the charging member of the charging apparatus is placed directly in contact with the image bearing member, and the image bearing member is uniformly charged by applying voltage to the charging member. In principle, however, this type of charging apparatus is the same as a corona type charging apparatus in that it also charges an object based on electrical discharge. Therefore, it also generates ozone, although by a smaller amount. Ozone forms nitric oxides (NOx), which are low in electrical resistance. Therefore, as nitric oxides adheres to the peripheral surface of the image bearing member, the image bearing member fails to be properly charged, resulting in the formation of defective images.

Thus, a charging process which does not suffer from the above described problem, that is, the ozone production, and is lower in the potential level of the voltage to be applied to a charging apparatus, has been proposed in Japanese Laid-open patent Application Hei 6-3921, or the like.

This charging process is characterized in that electrical charge is injected into the image bearing member through the direct exchange of electrical charge between the charging member, and the image bearing member surface placed in contact with the charging member, instead of electrical discharge.

Next, a charging apparatus for carrying out the above described charging process, or charge injection, will be described with reference to a sponge roller type charging apparatus (U.S. Pat. No. 6,128,456 or the like).

Referring to FIG. 5, the contact charging member of this type of charging apparatus is made up of a sponge roller 2-A, which is rotated in the direction b in contact with the image bearing member 1, and electrically conductive microscopic particles m (relatively low in electrical resistance) adhered to the peripheral surface of the porous portions, that is, the outer layer, of the sponge roller 2-A. Electrical charge is injected into the image bearing member 1 from the sponge roller 2-A at the contact area n, as the sponge roller 2-A is rotated in the direction counter to the rotational direction a of the image bearing member 1. As a result, the image bearing member 1 is charged to a potential level virtually identical to that of the electrical charge of the sponge roller 2-A.

The electrically conductive microscopic particles m are particles for enhancing the charging performance of the charging apparatus. As for the material for the electrically conductive microscopic particles m, various substances can be used; for example, microscopic particles of electrically conductive metallic oxide such as zinc oxide, microscopic particles of electrically conductive particles of inorganic substance other than metallic oxides, mixture of microscopic particles of electrically conductive inorganic and organic substances, and the like.

In this system, a DC voltage of −600 V is applied to the sponge roller 2-A from a power source S1. This voltage acts to raise the potential level of the portion of the image bearing member 1 in contact with the sponge roller 2-A and electrically conductive microscopic particles m to the same potential level as that of this voltage, that is, −600 V. If electrical charge from the sponge roller 2-A side can break through the barrier, or surface energy, of the peripheral surface of the image bearing member 1, it is injected into the image bearing member 1, charging the image bearing member 1. If electrical charge fails to break through this energetic barrier, the image bearing member 1 is not charged. Further, if electrical charge having been injected into the image bearing member 1 moves back from the image bearing member 1 to the sponge roller 2-A when the sponge roller 2-A is separated from the image bearing member 1, the image bearing member 1 does not remain charged. These phenomena are greatly affected by the energetic barrier of the peripheral surface of the image bearing member 1, and the charge retaining ability of the image bearing member 1. On the other hand, if a charging process is viewed as a process comprising a plurality of competing subordinate processes, the frequency at which the sponge roller 2-A makes contact with the image bearing member 1 is very important.

As for the means for increasing this frequency, it is effective to improve the state of contact between the sponge roller 2-A and image bearing member 1. The state of contact between the sponge roller 2-A and image bearing member 1 can be improved by adhering the electrically conductive microscopic particles m to the porous portion, or the surface layer, of the sponge roller 2-A, and/or by increasing the relative speed between the peripheral surfaces of the sponge roller 2-A and image bearing member 1 by making the moving direction of the peripheral surface of the sponge roller 2-A opposite to that of the peripheral surface of the image bearing member 1. With the provision of the above described arrangements, the peripheral surface of the image bearing member 1 is charged to a potential level virtually the same as that of the voltage applied to the sponge roller 2-A, that is, −600 V, uniformly, even in microscopic terms.

FIG. 6 is a schematic drawing of an example of an electrophotographic image forming apparatus which employs, as a means for charging the image bearing member 1, an injection type charging apparatus 2 which uses the above described electrically conductive microscopic particles m. This apparatus does not have a dedicated cleaning system, and employs a transfer type image formation system.

Designated by a referential code I is a rotational electrophotographic photoconductive member, in the form of a drum, which is rotationally driven at a predetermined peripheral velocity in the clockwise direction indicated by an arrow mark a. Designated by a referential code 2-A 2 is a sponge roller as a charging member, which is kept in contact with the image bearing member 1, with the application of a predetermined amount of pressure, forming a contact area n with a predetermined width in terms of the circumferential direction of the sponge roller 2. A referential code 2-B stands for a coating device for coating the peripheral surface of the sponge roller 2 with electrically conductive microscopic particles. As the sponge roller 2 is rotated in the clockwise direction indicated by an arrow mark b, the peripheral surface of the sponge charge roller 2 is coated with the electrically conductive microscopic particles m.

The peripheral surface of the image bearing member 1 is uniformly charged to predetermined polarity and potential level, as a predetermined charge bias is applied to the sponge charging roller 2 from the power source SI while the sponge charge roller 2 is rotationally driven in the direction counter to the rotational direction a of the image bearing member 1, with the electrically conductive microscopic particles m interposed in the contact area n, that is, the charging station, between the sponge charging roller 2 and image bearing member 1.

The uniformly charged peripheral surface of the image bearing member 1 is exposed by an unshown exposing means (digital scanning apparatus such as a laser beam scanner image projector for focusing the image of original, and the like)—a beam of light L reflecting image formation data is projected onto the uniformly charged peripheral surface of the image bearing member 1 from the exposing apparatus. As a result, an electrostatic latent image reflecting the exposure pattern is formed on the uniformly charged surface of the image bearing member 1.

Next, the electrostatic latent image is visualized as a developer image (toner image) by the sleeve 3-*a* of a noncontact (jumping) developing apparatus 3, in the development station f. Designated by a referential code t is the toner in the developing apparatus 3, and designated by a referential code c is the rotational direction of the development sleeve 3-*a*. Designated by a referential code S2 is a power source from which a predetermined development bias is applied to the development sleeve 3-*a*.

Next, in the transfer station g, that is, the contact area between the a transfer roller 5-*a* of a transferring apparatus 5 and the image bearing member 1, the development image is transferred onto a transfer medium p as recording medium delivered, with a predetermined control timing, from an unshown sheet feeding station to the transfer station g. Designated by a referential code d is the rotational direction of a transfer roller 5-*a,* and designated by a referential code S3 is a power source from which a predetermined transfer bias is applied to the transferring apparatus 5.

After the reception of the developer image in the transfer contact area g, the transfer medium p is separated from the image bearing member 1, and is introduced into an unshown fixing apparatus, in which the developer image is fixed. Thereafter, the transfer medium p is discharged as a print or a copy.

After the separation of the transfer medium p, the residual developer particles, that is, the developer particles remaining on the peripheral surface of the image bearing member 1 after the image transfer, are carried by the rotation of the image bearing member I through the charge station, and then, the development station, in which the residual developer particles are removed from the peripheral surface of the image bearing member 1 by the developing apparatus 3 at the same time as the latent image formed on the peripheral surface of the image bearing member 1 is developed by the developing apparatus 3, during the following rotation of the image bearing member 1.

The polarity of the electrically conductive microscopic particles m is made opposite to that of the developer t. Therefore, the electrically conductive microscopic particles m are not transferred onto the transfer medium, remaining on the image bearing member 1, and then, are recovered (picked up) by the sponge charging roller 2-A; in other words, the peripheral surface of the image bearing member 1 is cleared of the electrically conductive microscopic particles m, being restored for charge injection. With the provision of the above described structural arrangement, even if the developer t accumulates on the sponge charging roller 2-A, as long as the electrically conductive microscopic particles m are supplied by an amount large enough to overwhelm the effects of the developer t having accumulated on the sponge charging roller 2-A, it is possible to prevent the image bearing member 1 from being unsatisfactorily charged.

In the case of this type of image forming apparatus, positive voltage is applied to transfer the image on the image bearing member 1. Therefore, after the image transfer, developer particles remaining on the image bearing member 1 will have been positively charged. These positively charged untransferred residual developer particles are given a proper amount of negative charge while passing between the electrically conductive microscopic particles m and image bearing member 1 while the image bearing member 1 is being charged. Thus, while they pass through the area in which the development process is carried out, they are recovered by the developing apparatus 3; they are not allowed to pass the development station. In other words, a cleaner-less electrophotographic process is carried out.

The electrically conductive microscopic particles m can be supplied to the contact area n, or the charging station, between the sponge charging roller 2-A and image bearing member 1 also from the developing apparatus 3 (U.S. Pat. No. 6,128,456). In this case, the electrically conductive microscopic particles m are mixed in advance with the developer particles, so that the electrically conductive microscopic particles m are adhered to the peripheral surface of the image bearing member 1 by the developing member, and are carried (supplied) to the contact area n as the charging station, by the rotation of the developing member.

The present invention is an improvement regarding an image forming apparatus in which electrically conductive microscopic particles are supplied to the contact area between the charging member and image bearing member from the developing means, by way of the image bearing member.

Thus, in order to reliably charge the image bearing member using the above described structure, it is mandatory for the electrically conductive microscopic particles m to be reliably supplied to the peripheral surface of the sponge charging roller 2-A. However, when the toner image formed of the developer t on the peripheral surface of the image bearing member 1 is transferred onto the transfer medium p by the transferring apparatus 5, all the developer particles in the toner image do not necessarily transfer onto the transfer medium p; some of them remain on the image bearing member 1 and reach the sponge charging roller 2-A, accumulating on the sponge charging roller 2-A. The accumulation of the developer particles t on the peripheral surface of the sponge charging roller 2-A adversely affects the charging performance of the sponge charging roller 2-A. Therefore, it is possible that as the developer particles t accumulate on the peripheral surface of the sponge charging roller 2-A as described above, the image bearing member 1 will fail to be properly charged.

On the other hand, during a paper interval, an image is not formed, and therefore, there is no developer particle t which moves from the image bearing member 1 to sponge charging roller 2-A. Thus, the electrically conductive microscopic particles m can be more reliably supplied onto the peripheral surface of the sponge charging roller 2-A during a paper interval than during an image formation period. If a paper interval is shorter than the time it takes for the sponge charging roller 2-A to make one complete rotation, it is impossible for the electrically conductive microscopic particles m to be supplied to the sponge charging roller 2-A across its entire range in terms of its circumferential direction, and therefore, it is possible that the charging performance of the sponge charging roller 2-A will become uneven in terms of its circumferential direction.

SUMMARY OF THE INVENTION

The primary object of the present invention is to provide an image forming apparatus in which electrically conductive particles are reliably supplied to the charging member.

Another object of the present invention is to provide an image forming apparatus in which electrically conductive particles are supplied to the image bearing member regardless of the pattern of the image formed on the image bearing member.

Another object of the present invention is to provide an image forming apparatus in which electrically conductive particles are uniformly supplied to the charging member.

Another object of the present invention is to provide an image forming apparatus in which electrically conductive particles are supplied from the developing device to the region of the image bearing member corresponding to a paper interval, by a large amount.

Another object of the present invention is to provide an image forming apparatus suitable for a cleaner-less system, that is, a system lacking a dedicated cleaner.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS (Embodiment 1)

Figure 1:
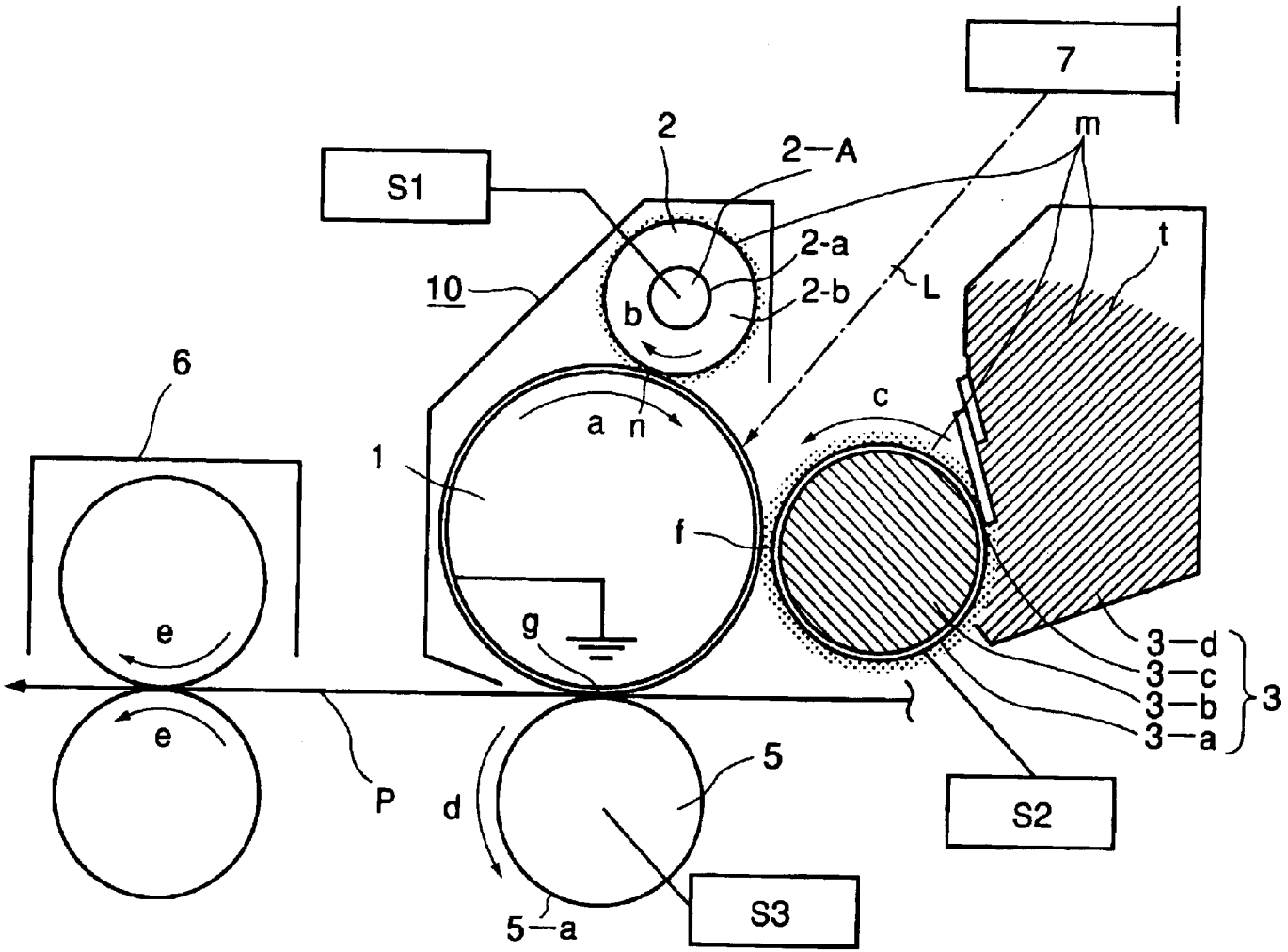
FIG. 1 is a schematic sectional view of the image forming apparatus in the first embodiment of the present invention, for showing the general structure thereof.

FIG. 1 is a schematic sectional view of an example of an image forming apparatus in accordance with the present invention, for showing the general structure thereof. The image forming apparatus in this embodiment is an electrophotographic image forming apparatus (laser beam printer), the charging means of which for charging the image bearing member is such a charging means that employs electrically conductive particles, and in which the electrically conductive microscopic particles are supplied from the developing means to the contact area between the charging member and image bearing member, by way of the image bearing member. It also employs a cleaner-less system and a transfer system.

(1) General Structure of Image Forming Apparatus

This image forming apparatus comprises: the image bearing member 1; injection type charging apparatus 2; developing apparatus 3 (developing device); transferring apparatus 5; fixing apparatus 6 (fixing device); exposing apparatus 7; and the like. The image bearing member 1, injection type charging apparatus 2, and developing apparatus 3 have been integrated into a process cartridge 10, which is mounted in the main assembly of the image forming apparatus, which contacts the transferring apparatus 5, fixing apparatus 6, and exposing apparatus 7.

An image (toner image) formed on the image bearing member I through a latent image formation process and development process is transferred by the transfer roller 5-*a* of the transferring apparatus 5 onto the transfer medium p as recording medium which is being conveyed by the transfer roller 5-*a* toward the fixing apparatus. Then, the image on the transfer medium p is fixed to the surface of the transfer medium p. Thereafter, the transfer medium p is discharged in the rotational direction e of the fixing apparatus 6.

a) Image Bearing Member I

The image bearing member 1 is an organic photoconductive member (negatively chargeable photoconductive member) with a diameter of 30 mm (which hereinafter will be referred to as photoconductive member). The photoconductive member 1 is rotationally driven by an unshown driving means at a peripheral velocity (which hereinafter will be referred to as process speed) of 50 mm/sec in the clockwise direction indicated by an arrow mark a.

b) Injection Type Charging Apparatus 2

The electrically conductive elastic roller 2-A (which hereinafter will be referred to as charge roller), as a contact charging member, of the injection type charging apparatus 2 is made up of a metallic core 2-*a*, and a layer 2-*b* of rubber or foamed substance, as a flexible portion, formed, in the shape of a roller, on the peripheral surface of the metallic core 2-*a*. The electrical resistance of the flexible layer 2-*b* is in the medium range. The material for the medium resistance layer 2-*b* is a mixture of resin (for example, urethane), electrically conductive microscopic particles (for example, carbon black), sulfurizing agent, foaming agent, and the like. If necessary, the peripheral surface of the medium resistance layer 2-*b* is polished to obtain the charge roller 2-A, as an electrically conductive roller, with a diameter of 12 mm. The measured resistance of the charge roller 2-A in this embodiment was $10^5$ (applied total pressure: 9.8 N; applied voltage: 100 V).

It is very important that the charge roller 2-A functions as an electrode. In other words, the charge roller 2-A must be elastic enough to remain satisfactorily in contact with the photoconductive member I as an object to be charged, and also, the electrical resistance of the charge roller 2-A must be low enough to charge the photoconductive member 1 while the photoconductive member 1 is rotating. On the other hand, it must be enabled to prevent such voltage leak that might occur if the photoconductive member 1 has defective areas, for example, an area with a pin hole.

When the object to be charged by the charge roller 2-A is an electrophotographic photoconductive member, the electrical resistance of the charge roller 2-A is desired to be in the range of $10^4$–$10^7$ Ohm, in order for the charge roller 2-A to be able to satisfactorily charge the charge roller 2-A while preventing electrical leak.

As for the hardness of the charge roller 2-A, if it is too low, the charge roller 2-A will be unstable in shape, failing to remain satisfactorily in contact with the photoconductive member 1, whereas if it is too high, it is impossible to secure the contact area n, or the charging station, between the peripheral surfaces of the charge roller 2-A and photoconductive member 1, and also, the state of the contact between the peripheral surfaces of the charge roller 2-A and photoconductive member 1 is inferior at a microscopic level. Thus, the hardness of the charge roller 2-A is desired to be in the range of 25 degrees to 50 degrees in Asker C scale.

The material for the charge roller 2-A does not need to be limited to foamed elastic substances. For example, it may be rubber such as EPDM, urethane, NBK, silicone rubber, IR, or the like, in which electrically conductive substance such as carbon black or metallic oxide is dispersed, and also, it may be the foamed version of the above described rubber. Further, the electrical resistance of the material for the charge roller 2-A may be adjusted by using an ion-conductive substance, instead of electrically conductive substance.

The charge roller 2-A is kept pressed upon the peripheral surface of the photoconductive member 1 so that a predetermined amount of pressure is generated and maintained between the peripheral surfaces of the charge roller 2-A and photoconductive member 1 against the elasticity of the charge roller 2-A. In this embodiment, the charge roller 2-A is rotationally driven at a peripheral velocity of 75 mm/sec in the clockwise direction indicated by an arrow mark so that the peripheral surfaces of the charge roller 2-A and photoconductive member 1 move in the opposite directions in the contact area (nip portion) between the charge roller 2-A and photoconductive member 1. In other words, the charge roller 2-A as a contact charging member is rotated in such a manner that a given point of the peripheral surface of the charge roller 2-A never remains in contact with the same point of the peripheral surface of the photoconductive member 1.

To the metallic core 2-*a* of the charge roller 2-A, a DC voltage of −620 V is applied as charge bias from a charge bias application power source S1. In this embodiment, electrical charge is directly injected into the photoconductive member 1, uniformly charging the peripheral surface of the photoconductive member 1 to a potential level approximately equal to the potential level (−600 V) of the voltage applied to the charge roller 2-A.

c) Exposing Apparatus 7

The exposing apparatus 7 is a laser beam scanner (exposing device) comprising a laser diode, a polygonal mirror and the like. This laser beam scanner outputs a laser beam L modulated in intensity with the sequential digital electrical signals reflecting the image formation data for a target image, scanning the uniformly charged peripheral surface of the photoconductive member 1, as the photoconductive member 1 is rotated. As a result, an electrostatic latent image in accordance with the image formation data for the target image is formed on the peripheral surface of the photoconductive member 1.

d) Developing Apparatus 3

The electrostatic latent image on the peripheral surface of the rotating photoconductive member 1 is developed into a toner image by the developing apparatus 3. The developing apparatus 3 in this embodiment is a reversal type developing apparatus which employs single-component magnetic dielectric toner t (negative toner) as developer.

A referential code 3-*a* stands for a nonmagnetic rotational development sleeve, as a developer bearing/conveying member, which contains a magnetic roll 3-*b*. The developer in the developer container 3-*d* is coated in a thin layer on the peripheral surface of this rotational development sleeve 3-*a* by a regulating blade 3-*c;* the thickness by which the developer, or toner, is coated on the rotational development sleeve 3-*a* is regulated by the regulating blade 3-*c*. As the toner is coated in a layer on the peripheral surface of the rotational development sleeve 3-*a* while being regulated in thickness by the regulating blade 3-*c,* it is given electrical charge. As the developer is coated on the peripheral surface of the rotational development sleeve 3-*a,* the developer is conveyed by the rotation of the sleeve 3-*a* to the development station f (development area), in which the photoconductive member I and sleeve 3-*a* oppose each other. Further, development bias is applied to the sleeve 3-*a* from a development bias application power source S2. The development bias in this embodiment is a combination of a DC voltage of −450 V, and an AC voltage which is 1,800 Hz in frequency, 1,600 V in peak-to-peak voltage, and rectangular in waveform. As a result, the electrostatic latent image on the peripheral surface of the photoconductive member 1 is developed by the toner, in the development station.

The developer in this embodiment is a mixture of toner t and electrically conductive microscopic particles m (charging performance enhancement particles) as electrically conductive particles. The toner t is formed in the following manner: polymerizable monomers and coloring agent (plus polymerization initiator, bridging agent, charge controlling agent, and other additives, if necessary) are uniformly dissolved or dispersed, forming a monomer compound; the thus formed monomeric compound is polymerized into toner particles, using a suspensive polymerization method in which the monomeric compound is polymerized while being dispersed, by an appropriate stirring device, in a continuous layer (for example, in liquid phase) containing dispersion stabilizer, and the electrically conductive microscopic particles m and fluidizing agent are added as external additives to the toner particles, to obtain the toner t developer. The weight average particle diameter (D4) of the toner t was 7 $\mu$m. In this embodiment, electrically conductive zinc oxide particles with a particle diameter of 3 $\mu$m was used as the electrically conductive microscopic particles m. Also in this embodiment, 1.5 parts in weight of electrically conductive microscopic particles m was externally added to 100 parts of toner t.

The average particle diameter and average particle distribution of the toner t was obtained using the following method. A Coulter counter TA-11, a Coulter multi-sizer (Coulter Co., Ltd.), or the like was connected to an interface (Nikkaki Co., Ltd) and a personal computer PC9801 (NEC) which output numerical distribution and volumetric distribution. Electrolytic solution was 1% water solution of NaC1, which was concocted using first class sodium chloride. For example, ISOTON R-11 (Coulter Scientific Japan Co., Ltd.) can be used. As for the measuring method, surfactant (preferably, alkyl benzene sodium sulphonates) was added as dispersant to 100–150 ml of the above described electrolytic water solution, and then, to this mixture, a test sample was added by 2–20 mg. The electrolytic solution, in which the test sample was suspended, was vibrated for approximately 1–3 minutes with the use of an ultrasonic dispersing device, thoroughly dispersing the test sample. Then, the volumetric distribution and numerical distribution of the toner particles were calculated by counting the number of the toner particles greater in diameter than 2 Am, and also measuring their volumes. Then, the volumetric weight average particle diameter (D4) was obtained from the volumetric distribution.

In this embodiment, electrically conductive zinc oxide particles inclusive of secondary agglomerate, which was $10^6$ Ωcm in specific resistivity and 3$\mu$ in the average particle diameter, was used as the electrically conductive microscopic particles m. However, various electrically conductive particles other than those used in this embodiment can also be used as the electrically conductive microscopic particles m, for example, electrically conductive inorganic particles other than zinc oxide particles, mixtures of inorganic and organic particles, and the like. The volumetric resistivity of the electrically conductive particles is desired to be no more than $10^{10}$ Ωcm.

The electrical resistance of the electrically conductive microscopic particles m was obtained by normalizing the electrical resistance of the electrically conductive microscopic particles m measured using a tableting method. More specifically, approximately 0.5 g of powdered test sample is placed in a cylinder with a bottom area of 2.26 $cm^2$, and the electrical resistance of the test sample was measured while applying a pressure of 147 N (15 kg) and a voltage of 100 V between the top and bottom electrodes. Then, the specific resistivity was obtained by normalizing the measured resistance.

e) Transferring Apparatus 5

In the transferring apparatus 5, a referential code 5-*a* stands for a transfer roller as contact transferring roller, the electrical resistance of which is the medium range. Pressure is maintained upon the peripheral surface of the photoconductive member 1, with the application of a predetermined amount of pressure, forming a contact area g for image transfer. To this transfer contact area g, the transfer medium p as recording medium is delivered from an unshown sheet feeding station with a predetermined timing, and a predetermined transfer bias is applied to the transfer roller 5-*a* from a transfer bias application power source S3, as the transfer medium p is passed through the transfer contact area g. As a result, the toner image on the peripheral surface of the photoconductive member 1 is continually transferred onto the surface of the transfer medium p. More specifically, while the transfer medium p is introduced into, and conveyed through, the transfer contact area g, being pinched by the transfer roller 5-*a* and photoconductive member 1, the toner image having been formed on the peripheral surface of the rotating photoconductive member 1 and borne thereon is continually transferred onto the transfer medium p by the electrostatic force and pressure.

After receiving the toner image from the photoconductive member 1 while being conveyed through the transfer contact area g, the transfer medium p is separated from the peripheral surface of the rotating photoconductive member 1, and is introduced into the fixing apparatus 6, in which the toner image is fixed to the transfer medium p. Thereafter, the recording medium p is discharged as a copy or a print from the image forming apparatus.

f) Process Cartridge 10

Among the above described components of the image forming apparatus in this embodiment, the photoconductive member 1, charge roller 2-A, and developing apparatus 3 are integrally disposed in a case (cartridge), forming a process cartridge 10, independent from the portion of the image forming apparatus, in which the components other than these three components are disposed (which hereinafter will be referred to as apparatus main assembly). Thus, these three components can be removably mountable in the apparatus main assembly.

g) Cleaner-less Cleaning System

The image forming apparatus in this embodiment is of a cleaner-less type; it does not have a system or means dedicated for cleaning the peripheral surface of the photoconductive member 1. Thus, the untransferred residual toner particles, that is, toner particles remaining on the peripheral surface of the rotating photoconductive member 1 after the transfer of the toner image onto the transfer medium, are not removed by a cleaner. Instead, as the photoconductive member 1 rotates, they go through the charging contact area n and reach the development station f, in which they are removed (recovered) by the developing apparatus 3 at the same time as the developing process is carried out by the developing apparatus 3 (toner recycling process).

The electrically conductive microscopic particles m mixed in the developer toner t in the developing apparatus 3 move, by a proper amount, along with toner particles, as the electrostatic latent image on the photoconductive member 1 is developed by the developing apparatus 3 which uses toner. The polarity to which the electrically conductive microscopic particles m are charged is opposite to the polarity to which the toner particles are charged; they are charged to positive polarity. Therefore, they adhere to the areas of the peripheral surface of the photoconductive member, which correspond to the non-image portions of the intended image during the latent image development. In the transfer contact area g, the toner image on the photoconductive member 1 aggressively transfers onto the transfer medium p by being affected by the transfer bias, whereas the electrically conductive microscopic particles m on the photoconductive member 1 are electrically conductive, and therefore, they do not transfer onto the transfer medium, remaining virtually adhered to the photoconductive member 1.

An image forming apparatus employing the toner recycling process does not employs a cleaner. Therefor, the untransferred residual toner particles remaining on the peripheral surface of the photoconductive member 1 after image transfer, and the above described residual electrically conductive microscopic particles m, are intactly carried by the rotation of the photoconductive member 1 to the charging contact area n (nip portion) between the photoconductive member 1 and charge roller 2-A as a contact charging member, and adhere to and/or invade into, the peripheral surface of the charge roller 2-A. As a result the photoconductive member I is charged by the charge roller 2-A, with the presence of the electrically conductive microscopic particles m in the contact area n between the photoconductive member I and charge roller 2-A.

Immediately after an image forming operation is started, the electrically conductive microscopic particles m have not been supplied to the peripheral surface of the charge roller from the developing apparatus by way of the photoconductive member. Therefore, the peripheral surface of the photoconductive member is not efficiently charged. Thus, it is desired that the peripheral surface of the charge roller is coated in advance with the electrically conductive microscopic particles m to make it possible for the peripheral surface of the charge roller to be efficiently charged even before the electrically conductive microscopic particles m begin to arrive at the peripheral surface of the charge roller by way of the photoconductive member.

With the presence of these electrically conductive microscopic particles m, even after the toner particles have adhered to, and/or invaded into, the charge roller 2-A, the electrical conduction and contact friction between the peripheral surfaces of the charge roller 2-A and photoconductive member 1 remain satisfactory. In other words, with the provision of the above described structural arrangement in this embodiment, electrical charge can be injected into the photoconductive member 1 to satisfactorily charge the photoconductive member 1 in spite of the fact that a simple component such as the charge roller 2-A is is used as a contact charging member, and that the contact charging member is contaminated by the residual toner particles. This is for the following reason. That is, in the contact area between the charge roller 2-A and photoconductive member 1, the electrically conductive microscopic particles m are present between the peripheral surfaces of the charge roller 2-A and photoconductive member 1, and are in contact with both the peripheral surfaces of the charge roller 2-A and photoconductive member 1. Therefore, as the charge roller 2-A and photoconductive member 1 are rotationally driven, the electrically conductive microscopic particles m in the contact area between the charge roller 2-A and photoconductive member 1 rub the peripheral surface of the photoconductive member 1, missing virtually no spot. As a result, electrical charge is directly injected into the photoconductive member 1 from the charge roller 2-A, charging the photoconductive member 1. In other words, with the presence of the electrically conductive microscopic particles m in the contact area between the charge roller 2-A and photoconductive member 1, the photoconductive member 1 is charged dominantly through direct charge injection, which is stable and safe, instead of electrical discharge. Therefore, the photoconductive member I is given a potential level virtually equal to that of the voltage applied to the charge roller 2-A; a charging efficiency which is impossible to accomplish with the use of a conventional charge roller or the like is accomplished.

The untransferred residual toner particles having adhered to, and/or invaded into, the charge roller 2-A are gradually expelled from the charge roller 2-A onto the peripheral surface of the photoconductive member 1, and are carried by the movement of the peripheral surface of the photoconductive member I to the development station, in which they are removed (recovered) by the developing apparatus 3 at the same time as the developing apparatus 3 carries out the development process. In the case of this developing/cleaning process, the toner particles remaining on the photoconductive member 1 after image transfer are recovered by the fog prevention bias. More specifically, after the toner image on a given portion of the peripheral surface of the photoconductive member 1 is transferred, this portion of the peripheral surface of the photoconductive member 1 is charged again and is exposed for the formation of the next latent image. Then, during the development of this latent image, the residual toner particles from the preceding rotational cycle of the photoconductive member I are recovered by the fog prevention bias of the developing apparatus, that is, the difference Vback in potential level between the DC voltage applied to the developing apparatus and the surface voltage of the photoconductive member. In the case of an image forming apparatus such as the printer in this embodiment, in which a latent image is developed in reverse, this developing/cleaning process is carried out by the electric field for recovering the toner particles from the areas of the peripheral surface of the photoconductive member, the potential level of which corresponds to the dark areas of a latent image, and the electric field for adhering toner particles to the areas of the peripheral surface of the photoconductive member, the potential level of which corresponds to the light areas of the latent image.

Further, as the image forming apparatus is operated, the electrically conductive microscopic particles m in the developer in the developing apparatus 3 move onto the peripheral surface of the photoconductive member 1, in the development station, and are carried by the rotation of the photoconductive member 1 through the transfer contact area g and to the charge contact area n, in which they are supplied to the charge roller 2-A. In other words, the charge roller 2-A is continuously supplied with the electrically conductive microscopic particles m. Therefore, even if some electrically conductive microscopic particles m fall off the charge roller 2-A, the electrically conductive microscopic particles m are always present on the charge roller 2-A by a sufficient amount for satisfactorily charging the photoconductive member 1.

As is evident from the above description of this embodiment, according to this embodiment of the present invention, the photoconductive member can be uniformly and reliably charged for a long period of time, with the use of a direct charge injection process, in which the potential level of the voltage to be applied to the charge roller is relatively low, in spite of the fact that in an image forming apparatus which employs a contact charging method, a contact transferring method, a toner recycling process, and a charge roller as a contact charging member, the charge roller is contaminated with untransferred residual toner particles. Therefore, it is possible to provide an image forming apparatus which is inexpensive, is simple in structure, and does not suffer from the problems traceable to the image formation byproducts such as ozone, unsatisfactory charging performance, and the like.

(2) Paper Interval Control

For the following two reasons 1) and 2), the electrically conductive microscopic particles m are most efficiently supplied to the charge roller 2-A during a paper interval. Here, a paper interval means the time between when the trailing edge of a given recording medium passes the transfer station and when the leading edge of the immediately following recording medium reaches the transfer station, during an image forming operation in which a plurality of images are transferred in succession onto a plurality of recording mediums one for one. Thus, no image is formed across the region of the peripheral surface of the photoconductive member 1 corresponding to a paper interval, and therefore, this region of the peripheral surface of the photoconductive member 1 does not come into contact with a recording medium.

1) The electrically conductive microscopic particles m are opposite in polarity to the toner particles t. Therefore, while a latent image is developed, the electrically conductive microscopic particles m are supplied from the developing apparatus 3 to the photoconductive member 1 by the difference (back contrast) in potential level between the areas of the peripheral surface of the photoconductive member 1 corresponding to the dark areas of a latent image and the potential level of the voltage applied to the development sleeve 3-*a*.

An image is not formed across the area of the peripheral surface of the photoconductive member 1 corresponding to a paper interval. Therefore, the electrical charge of this area of the photoconductive member I remains uniform at the dark area potential level. Therefore, while this area of the photoconductive member 1 passes the development station, the back contrast remains constant, causing the electrically conductive microscopic particles m to be supplied to the peripheral surface of the photoconductive member 1 without being unevenly distributed.

2) During a paper interval, no image is formed, producing no untransferred residual toner particles, and no transfer medium p is present in the transfer contact area g, preventing the electrically conductive microscopic particles m on the photoconductive member 1 from adhering to a transfer medium, making it more likely for the electrically conductive microscopic particles m on the photoconductive member 1 to reach the charge roller 2-A.

The present invention was made in view of the above described fats. Thus, according to the present invention, the length of a paper interval is made to be no less than the time it takes for the charge roller 2-A as a charging member to completely rotate once, so that the electrically conductive microscopic particles m are supplied across the entirety of the peripheral surface of the charge roller 2-A by the area of the photoconductive member 1 corresponding to a paper interval. Therefore, it is possible to provide a process cartridge capable of forming satisfactory images for a long period of time, and also, an image forming apparatus employing such a process cartridge. With the provision of the above described arrangement, the time it takes for the area of the peripheral surface of the photoconductive member 1 coated uniformly with the electrically conductive microscopic particles m to pass the charging nip portion becomes longer than the time it takes for the charge roller to rotate once. Therefore, the electrically conductive microscopic particles m are supplied to the charge roller uniformly across the entirety of the peripheral surface thereof.

In this embodiment, the diameter and peripheral velocity of the charge roller 2-A have been set to 12 mm and 75 mm/sec, respectively. Therefore, the time it takes for the charge roller 2-A to completely rotate once is approximately 0.5 second.

Thus, the paper interval, or the interval, in terms of time, between the trailing edge of a given transfer medium and the leading end of the immediately following transfer medium has been set to 0.55 second. In other words, the timing with which a plurality of transfer mediums p are supplied in succession to the transfer station is (length of transfer medium p/process speed) +0.55 second. For example, when a plurality of transfer mediums p of A4 size (297 mm in length) are supplied in succession to the transfer station, with the lengthwise direction of the transfer medium p being parallel to the recording medium conveyance direction (oriented in portrait fashion), while rotating the photoconductive member at a peripheral velocxty of 50 mm/see, the paper interval in terms of time from when the first transfer medium p begins to be fed and when the second transfer medium p should begin to be fed is 6.49 second:

$$(297.0/50)+0.55=6.49 \text{ (second)}.$$

Figure 2:
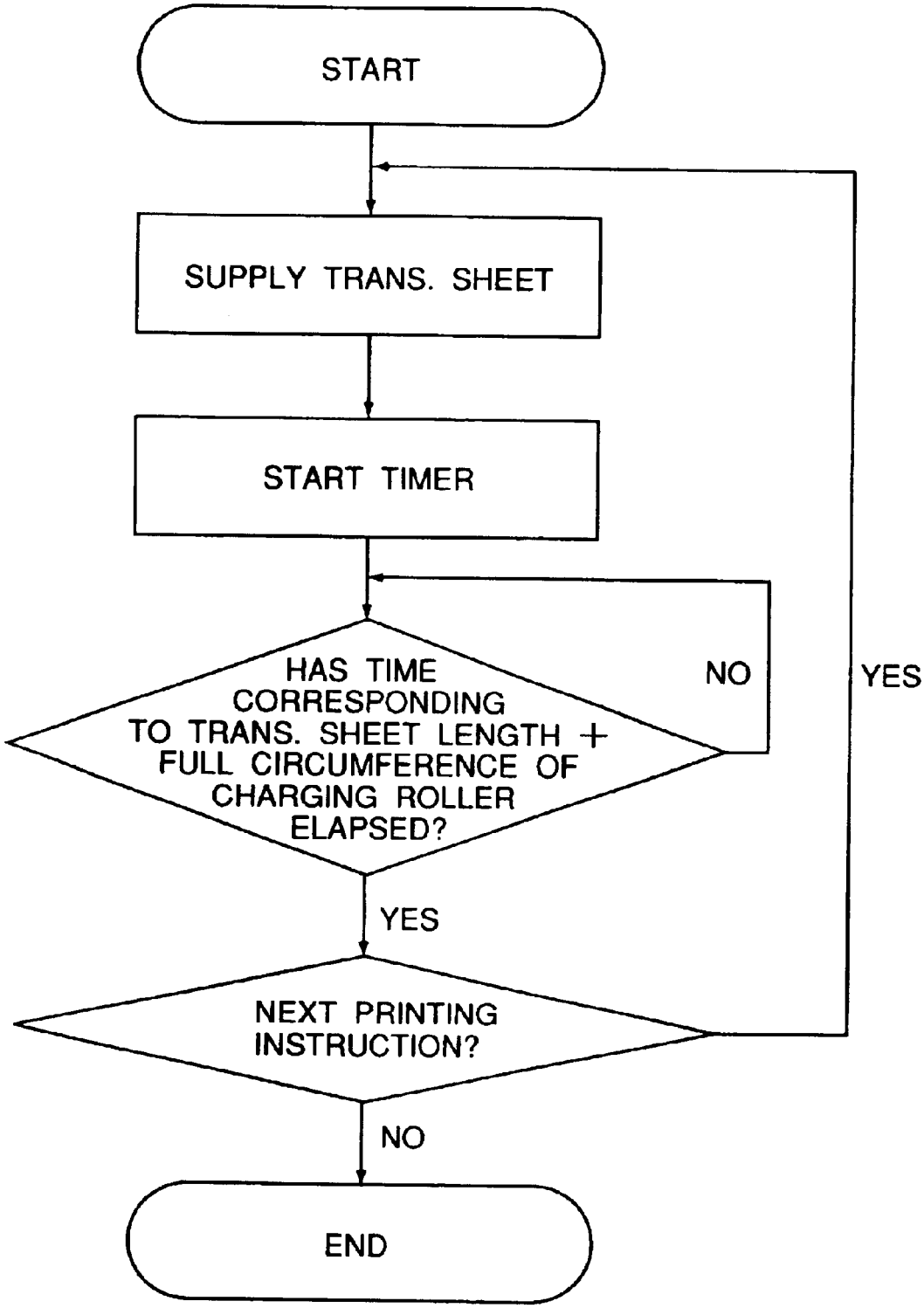
FIG. 2 is a flowchart for determining the paper feeding timing for the image forming apparatus in the first embodiment of the present invention.

FIG. 2 is the flowchart in this embodiment.

When the feeding of the first transfer member p (medium) begins, a timer is started, and the transfer medium feeding device is kept on standby for a duration equal to the sum of the transfer medium conveyance time and the time it takes for the charge roller 2-A to completely rotate once.

Then, it is detected whether or not the next print command had arrived during the paper interval. If it is detected that the next print command had arrived, the next transfer medium p is fed to form an image. This routine is repeated until it is detected that a print command had not arrived; the image forming operation is stopped as it is detected that no print command had arrived.

The above described paper interval control sequence is carried out by an unshown control portion of the image forming apparatus.

As described above, according to this embodiment of the present invention, the length of a paper interval in terms of time is made to be no less than the time it takes for the charge roller 2-A to completely rotate once. Therefore, the entirety of the peripheral surface of the charge roller 2-A is supplied with the electrically conductive microscopic particles m by the area of the peripheral surface of the photoconductive member 1 corresponding to a paper interval. Therefore, it is possible to provide a process cartridge capable of forming satisfactory images for a long period of time, and an image forming apparatus employing such a process cartridge.

The above described embodiment of the present invention is only one example of the embodiment of the present invention. It is obvious that this embodiment can be modified within the range in which the gist of the present invention is not altered. For example, although, in this embodiment, the length of the paper interval in terms of time has been set to be approximately equal to the time it takes for the charge roller, as a charging member, to completely rotate once, it is needless to say that even if the paper interval is made far longer than the time it takes for the charge roller to completely rotate once, there will be no ill effects at all.

(Embodiment 2)

This embodiment is intended for widening paper intervals according to the number of transfer mediums passed through the transfer station during a continuous printing operation.

The period in which the electrically conductive microscopic particles m can be efficiently supplied to the charge contact area g (nip portion) without being affected by untransferred residual toner particles and the like, while an image forming apparatus is continuously forming a plurality of images, in other words, while a plurality of transfer mediums are continually supplied to the transfer station, is limited to paper intervals. Therefore, while a plurality of transfer mediums are supplied in succession to the transfer station, the margin for the charging error is likely to be smaller than while the plurality of image forming operations are discontinuously supplied. This tendency is more apparent when the image formation data is high in printing ratio (when the ratio of dark areas is high). Thus, in this embodiment, when a plurality of images are continually formed, the margin for the charging error s increased by adjusting the length of a paper interval according to the number of transfer mediums delivered to the transfer station g.

The image forming apparatus in this embodiment is virtually the same as that in the first embodiment, except that the one in this embodiment is provided with a means for counting the number of transfer mediums p having passed through the transfer contact area g after the starting of an image formation sequence for continually forming a plurality of images (continuous printing operation). Thus, the descriptions of the portions of the image forming apparatus in this embodiment identical to those in the first embodiment will not be given here. The transfer medium counting means is provided in the unshown control portion of the image forming apparatus, which carries out the control sequence for adjusting the paper interval length in terms of time according to the transfer medium count obtained by the transfer medium counting means.

TABLE 1

| Intervals | No. of charging error |
|---|---|
| One full circle | 160 sheets |
| Two full circles | 350 sheets |
| Three full circle | 500 sheets |

Table 1 given above shows, in relation to paper interval length, the results of a test carried out to find out how many transfer mediums were passed through the transfer station before a charging error began while 500 copies were made based on image formation data with a high printing ratio (50%) suing A4 recording papers, which were oriented in the portrait fashion. Here, "charging error" means the phenomenon that due to the drop in potential level across certain spots of the peripheral surface of the photoconductive member 1, toner adheres thereto, and effects unwanted black spots, the size of which is no less than 0.8 mm, on the transfer medium. "Single complete rotation" in the table means a paper interval, the length of which in terms of time is equal to the time it takes for the charge roller 2-A to completely rotate once. In this embodiment, it is approximate 0.5 second. Further, "printing ratio" means the ratio of the number of black dots in a set of image formation data equivalent to a single page (number of dots in black areas/(black area+white areas)). As is evident from the table, the shorter the paper interval, the smaller the amount by which the electrically conductive microscopic particles are supplied to the charge roller, and therefore, the smaller the number of the copies which can be formed before the charging error begins.

TABLE 2

| No. of sheets at which interval is switched | No. of charging errors |
|---|---|
| 50 sheets | 350 sheets |
| 100 sheets | 345 sheets |
| 150 sheets | 340 sheets |

Table 2 given above shows the results of a test in which the paper interval is switched from the time it takes for the charge roller to completely rotate once to the time it takes for the charge roller to completely rotate twice, after a predetermined number (paper interval switching count) of transfer mediums are continuously fed, while continually making copies at a high printing ratio of 50%, using A4 recording papers which were oriented in the portrait fashion.

According to Table 1, when the transfer mediums were continually passed through the transfer station, with the paper interval set to the time it takes for the charge roller 2 to completely rotate twice, the charging error began after 350 transfer mediums were passed. In comparison, according to Table 2, in an image forming operation in which a plurality of copies were continually printed, the first 50 transfer mediums were continually fed with the paper interval set to the time it takes for the charge roller to completely rotate once, and thereafter, the paper interval was switched to the time it takes for the charge roller to completely rotate twice. Yet, the charging error did not occur until 350 transfer mediums were fed. In other words, this switching of the paper interval had merit in that it increased the throughput of the image forming apparatus by the amount equivalent to the time saved due to the shorter paper intervals for the first 50 transfer mediums. Although there is a tendency that as the number of the transfer mediums passed through the transfer station before the paper interval is lengthened is increased, the number of transfer mediums which can be passed before the charging error begins slightly reduces, the effects of this tendency is very slight. It may be thought that the merit, that is, the increase in throughput, of keeping the paper intervals relatively short until a predetermined number of transfer mediums are passed through the transfer station immediately after the beginning of an image forming operation, outweighs the demerit, that is, the slight increase in the number of transfer mediums which can be passed before the charging error begins.

In addition, the number of transfer mediums which can be passed through the transfer station before the charging error begins to occur can be increased by further lengthening the paper intervals before the charging error begins to occur.

Thus, in this embodiment, a sequence in which the length of the paper interval in terms of time is adjusted with reference to three predetermined transfer medium counts as shown in the following Table 3 was employed. Table 3 confirms that with the employment of this sequence, the charging error did not begin to occur until 500 transfer mediums of A4 size were continually fed in the portrait fashion.

TABLE 3

| No. of continuously fed sheets | Intervals |
|---|---|
| <150 | one full circle |
| 150–300 | two full circles |
| >300 | three fill circle |

Figure 3:
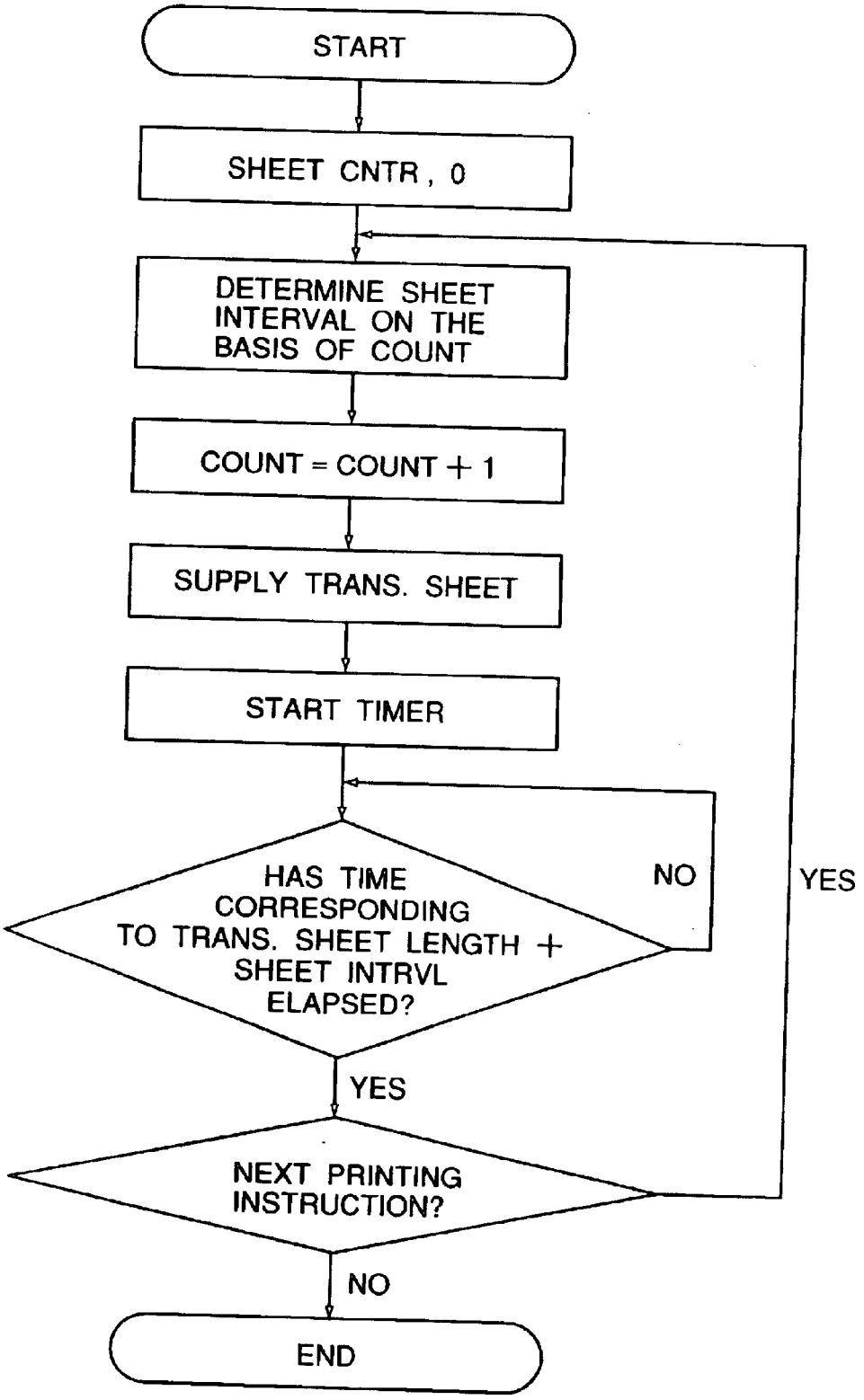
FIG. 3 is a flowchart for determining the paper feeding timing for the image forming apparatus in the second embodiment of the present invention.

FIG. 3 is the flowchart, in this embodiment, for controlling the paper interval.

After the transfer medium counter is cleared, a plurality of the transfer medium counts, at which the paper interval in terms of time is adjusted, are incrementally selected, and the transfer medium counter is set to the selected counts.

Then, the timer is started after the first transfer medium p is fed, and the transfer medium feeding device is kept on standby for a duration equal to (transfer medium p conveyance time+predetermined paper interval).

Then, if it is detected that the second print command had arrived, the length of the next paper interval is determined, and the transfer medium p is fed. This sequence is continuously repeated, and the image forming operation is ended as it is detected that no print command had arrived.

In this embodiment, the sequence in which three paper intervals were provided was employed. However, this is only one example of the embodiment of the present invention; the number of the paper intervals may be increased or decreased as necessary.

In order to prevent a charging error while continually printing 500 copies of A4 size, in the portrait fashion, based on the image formation data with a printing ratio of 50%, with a paper interval kept constant, it is necessary for the paper interval to be set to a value no less than the time it takes for the charge roller to completely rotate three times. In this embodiment, during the printing of the first 150 copies, the paper interval was kept at a value equivalent to complete rotations of the charge roller, and during the printing of 151th to 300th copies, the paper interval was kept at a value equivalent to two complete rotations of the charge roller. With this arrangement, the time necessary for completing an image forming operation can be reduced compared to when the paper interval is kept constant. As described above, the time it takes for the charge roller to completely rotate once is approximately 0.5 second. Therefore, this arrangement can reduce the time necessary for completing the image forming operation, by 225 seconds:

$$1.0\times150+0.5\times150=225 \text{ sec}$$

In other words, according to this embodiment of the present invention, the paper interval in terms of time is adjusted according to the number of transfer mediums passed through the transfer station after an image forming apparatus begins an operation in which a plurality of copies are continually printed. Therefore, the margin for the charging error is greater, making it possible to provide a process cartridge capable of forming satisfactory images for long period of time, and an image forming apparatus capable of forming satisfactory images for a long period of time, by employing such a process cartridge.

(Embodiment 3)

In this embodiment, the paper interval in terms of time is adjusted according to the magnitude of the demand for the electrically conductive microscopic particles m. More concretely, it is adjusted according to the magnitude of a single or plurality of the factors (for example, printing ratio) which affect the magnitude of the demand for the electrically conductive microscopic particles m.

The greater the amount of the transferred residual toner, the greater the amount by which the electrically conductive microscopic particles m must be supplied to the charge roller 2-A. Therefore, the margin for the stabilization of the charging performance can be increased by increasing the amount by which the electrically conductive microscopic particles m are supplied, by lengthening each paper interval in proportion to the ratio of the black areas relative to the white areas, in an intended image.

The image forming apparatus in this embodiment is virtually the same as that in the first embodiment, except that the laser scanner 7 in this embodiment is provided with a means for retaining the image formation data regarding the printing ratio. Thus, the descriptions of the portions of the image forming apparatus in this embodiment identical to those in the first embodiment will not be given here.

TABLE 4

| | Printing ratios | | | | |
|---|---|---|---|---|---|
| Interval | 5% | 10% | 20% | 50% | 100% |
| 1 circle | 500 | 450 | 380 | 160 | 50 |
| 2 circles | 500 | 500 | 480 | 350 | 170 |
| 3 circles | 500 | 500 | 500 | 500 | 490 |
| 4 circles | 500 | 500 | 500 | 500 | 500 |

Table 4 given above shows the results of a test carried out to find how many transfer mediums were passed through the transfer station before a charging error (which resulted in a black spot which is no less than 0.8 mm in size) began while 500 transfer mediums of A4 size (oriented in portrait fashion) were continually passed through the transfer station, with the paper interval and printing ratio kept constant. As is evident from Table 4, the higher the printing ratio, and the shorter the paper interval, the smaller the number of transfer mediums which could be passed through the transfer station before the charging error began.

Thus, the inventors of the present invention created an image forming apparatus in which the length of the paper interval y (in terms of the number of complete rotation of charge roller) between a transfer medium, on which an image was formed at a printing ratio of ×(%), and the next transfer medium, was determined based on the relationship expressed in the form of the following mathematic formula:

$$y=[x/5]+1(0\leqq x<10)[x/50]+3(10\leqq x<100) \quad (1)$$

In the above formula, the bracket stands for a Gauss sign. As long as the paper interval length is determined based on the above mathematical formula, the charging error did not occur, and the paper interval was not unnecessarily lengthened, no matter how many images were continually formed based on the image formation data with a high printing ratio.

Figure 4:
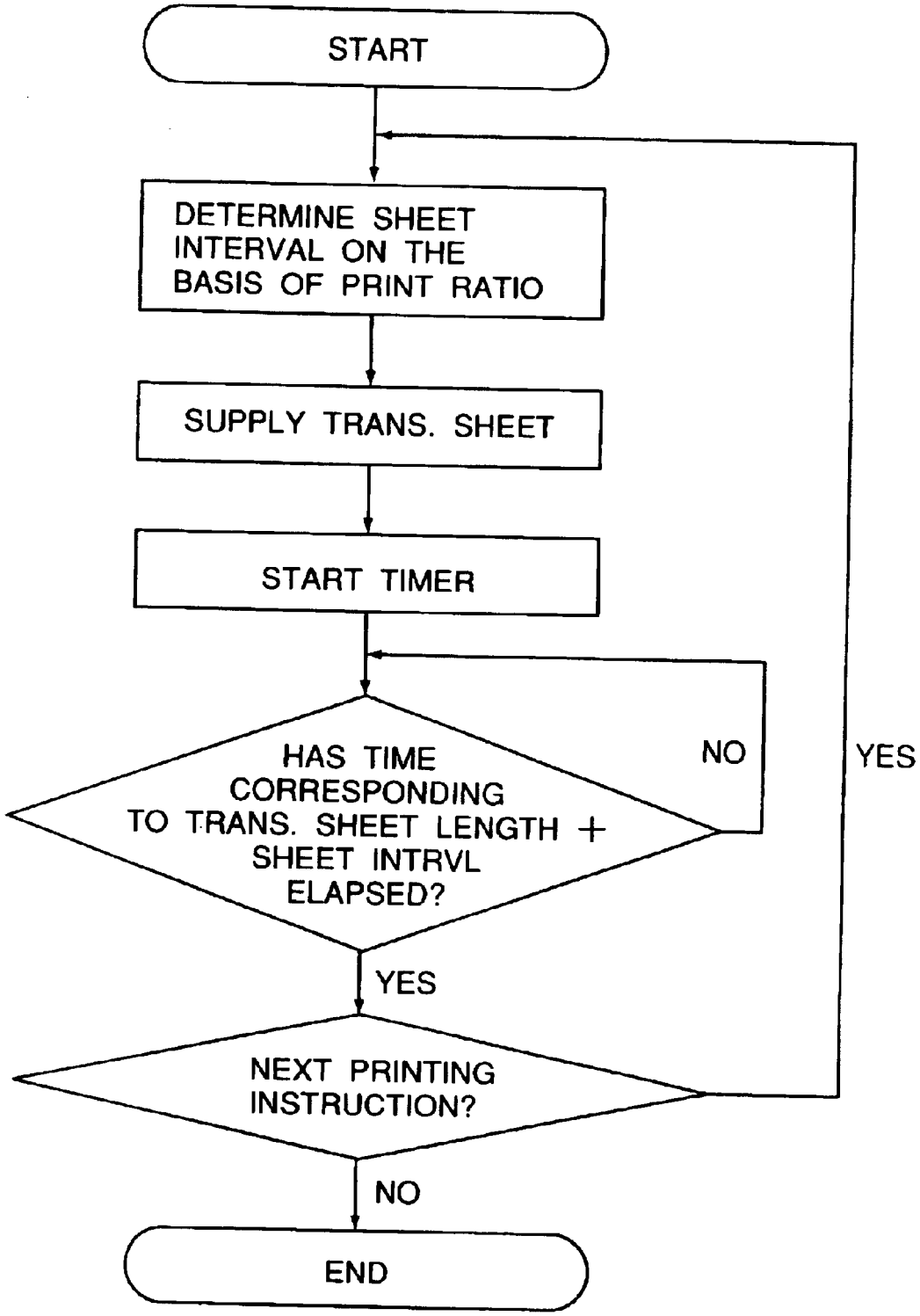
FIG. 4 is a flowchart for determining the paper feeding timing for the image forming apparatus in the third embodiment of the present invention.
Figure 5:
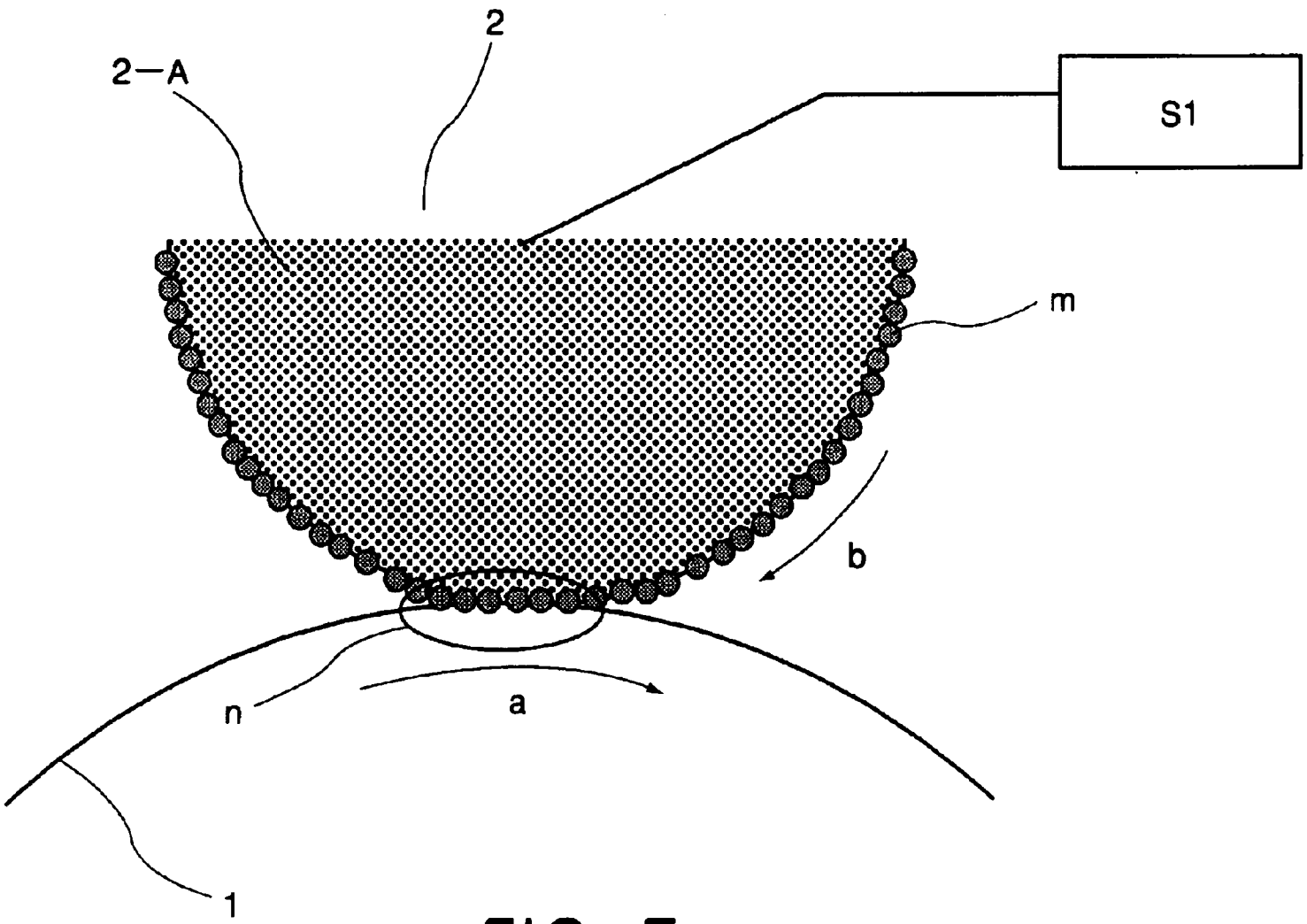
FIG. 5 is a schematic drawing for describing a contact charge injecting means employing electrically conductive particles.
Figure 6:
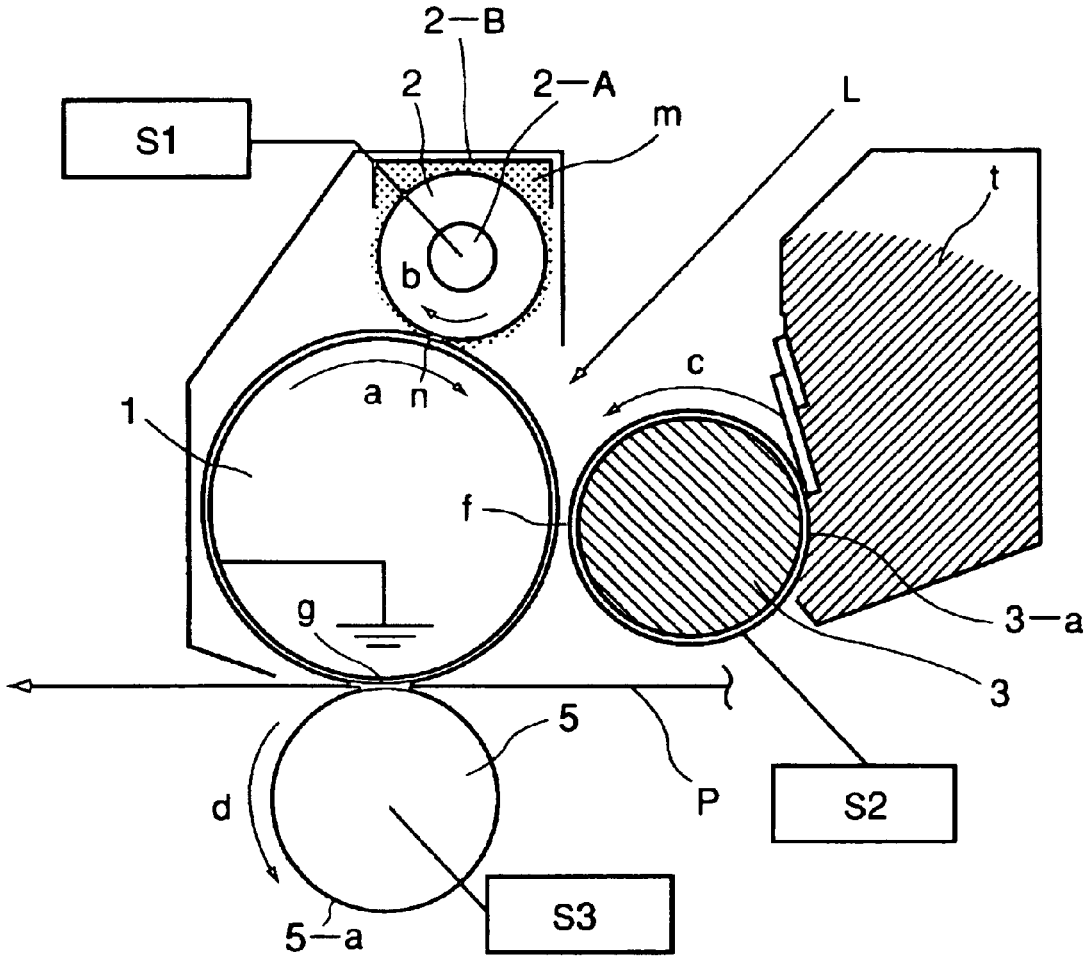
FIG. 6 is a schematic sectional view of an example of a cleaner-less image forming apparatus, the charging means of which for charging the image bearing member is a contact charge injecting means employing electrically conductive particles, for showing the general structure thereof.

FIG. 4 is a flowchart, in this embodiment, for controlling the paper interval in terms of time.

First, the paper interval length is determined based on the printing ratio of the image formation data of an image to be printed, using mathematical formula (1).

Next, the timer is started as the first transfer medium p is fed. Then, the transfer medium feeding device is kept on standby for a duration equal to (transfer medium p conveyance time+predetermined paper interval) as was in the first embodiment.

Then, if it is detected that the second printing command had arrived, the length of the next paper interval is determined according to the printing ratio for the next page, and the transfer medium p is fed. This sequence is continuously repeated, and the image forming operation is ended as it is detected that no printing command had arrived.

In other words, according to this embodiment of the present invention, the paper interval is adjusted according to the printing ratio to prevent the charging error. Therefore, it does not occur that the throughput is reduced due to the useless lengthening of the charging error. Therefore, it is possible to provide a process cartridge capable of continually forming satisfactory images for a long period of time, and an image forming apparatus capable of continually forming satisfactory images using such a process cartridge.

(Others)

1) The image bearing member may be an electrostatically recordable dielectric member or the like. In such a case, the surface of an dielectric member is uniformly charged (primary charge) to predetermined polarity and potential level, and the electrostatic latent image of an intended image is written by selectively removing the charge on the surface of the dielectric member with the use of a charge removing means such as an electron gun.

2) The recording medium which receives a toner image from the image bearing member may be an intermediary transferring member such as a transfer drum.

As described above, according to the present invention, the paper interval in terms of time for an image forming apparatus inclusive of a process cartridge, such as an electrophotographic copying machine or a laser beam printer, the charging means of which for charging the image bearing member, for example, an electrophotographic photoconductive member, an electrostatically recordable dielectric member, or the like, employs electrically conductive microscopic particles, and in which the electrically conductive microscopic particles are supplied to the contact area between the charging member and image bearing member from the developing means by way of the image bearing member, is made to be no less than the time it takes for the charging member to completely rotate once. Therefore, the electrically conductive microscopic particles are supplied to the entirety of the peripheral surface of the charging member during each paper interval, making it possible to provide a process cartridge capable of continually forming satisfactory images for a long period of time, and an image forming apparatus capable of continually forming satisfactory images using such a process cartridge.

Further, according to the present invention, the paper interval, in terms of time, in an image forming operation in which a plurality of copies are continually printed, is lengthened according to the number of transfers of media passed through the transfer station and/or printing ratio, increasing the margin for operational stability.

While the invention has been described with reference to the structures disclosed herein, it is not confined to the details set forth, and this application is intended to cover such modifications or changes as may come within the purposes of the improvements or the scope of the following Claims.

What is claimed is:

1. An image firming apparatus comprising:

an image bearing member;

a rotatable charging member, forming a nip with said image bearing member, for electrically charging said image bearing member;

developing means for developing an electrostatic image formed on said image bearing member to form a toner image, said developing means supplying electroconductive particles to said image bearing member, wherein the electroconductive particles are fed to the nip by said image bearing member;

transferring means for transferring the toner image onto a recording material at a transfer position;

wherein said developing means is capable of feeding the electroconductive particles to a region of said image bearing member which corresponds to a region between a first recording material and a second recording material immediately subsequent to the first recording material, and a time period from passage of a trailing end of the first recording material through the transfer position to arrival of a leading end of the second recording material at the transfer position is longer than a time period required for said charging member to rotate one full-turn.

2. An apparatus according to claim 1, wherein said developing means is capable of feeding the electroconductive particles to said image bearing member during a developing operation of said image bearing member.

3. An apparatus according to claim 2, wherein the electroconductive particles are supplied to a non-image portion of said image bearing member.

4. An apparatus according to claim 1, wherein the electroconductive particles are charged to a polarity opposite that of a charging polarity of the toner.

5. An apparatus according to claim 1, wherein said charging member is supplied with a voltage.

6. An apparatus according to claim 1, wherein said charging member is made of a flexible member.

7. An apparatus according to claim 1, wherein said charging member is rotated with a peripheral speed difference relative to said image bearing member.

8. An apparatus according to claim 1, wherein said charging member is rotated in a direction opposite that of said image bearing member at the nip.

9. An apparatus according to claim 1, wherein said developing means is capable of collecting residual toner from said image bearing member simultaneously with a developing operation of said image bearing member.

10. An apparatus according to claim 1, wherein said charging member carries other electroconductive particles before said charging member is supplied with the electroconductive particles from said image bearing member.

11. An apparatus according to claim 1, wherein said charging member effects injection charging into said image bearing member through the nip.

12. An apparatus according to claim 1, wherein said image bearing member, said charging member and said developing means are contained in a process cartridge which is detachably mountable to a main assembly of said image forming apparatus.

13. An image forming apparatus comprising:

an image bearing member;

a rotatable charging member, forming a nip with said image bearing member, for electrically charging said image bearing member;

developing means for developing an electrostatic image formed on said image bearing member to form a toner image, said developing means supplying electroconductive particles to said image bearing member, wherein the electroconductive particles are fed to the nip by said image bearing member;

transferring means for transferring the toner image onto a recording material at a transfer position;

wherein said developing means is capable of feeding the electroconductive particles to a region of said image bearing member which corresponds to a region between a first recording material and a second recording material immediately subsequent to the first recording material, and a time period from passage of a trailing end of the first recording material through the transfer position to arrival of a leading end of the second recording material at the transfer position is variable in accordance with a number of recording materials continuously passing through the transfer position.

14. An apparatus according to claim 13, wherein the time period from passage of a trailing end of the first recording material through the transfer position to arrival of a leading end of the second recording material at the transfer position is longer than a time period required for said charging member to rotate one full-him.

15. An apparatus according to claim 13, wherein said developing means is capable of feeding the electroconductive particles to said image bearing member during its developing operation.

16. An apparatus according to claim 15, wherein the electroconductive particles are supplied to a non-image portion of said image bearing member.

17. An apparatus according to claim 13, wherein the electroconductive particles are charged to a polarity opposite that of a charging polarity of the toner.

18. An apparatus according to claim 13, wherein said charging member is supplied with a voltage.

19. An apparatus according to claim 13, wherein said charging member is made of a flexible member.

20. An apparatus according to claim 13, wherein said charging member is rotated with a peripheral speed difference relative to said image bearing member.

21. An apparatus according to claim 13, wherein said charging member is rotated in a direction opposite that of said image bearing member at the nip.

22. An apparatus according to claim 13, wherein said developing means is capable of collecting residual toner from said image bearing member simultaneously with its developing operation.

23. An apparatus according to claim 13, wherein said charging member carries other electroconductive particles before said charging member is supplied with the electroconductive particle from said image bearing member.

24. An apparatus according to claim 13, wherein said charging member effects injection charging into said image bearing member through the nip.

25. An apparatus according to claim 13, wherein said image bearing member, said charging member and said developing means are contained in a process cartridge which is detachably mountable to a main assembly of said image forming apparatus.

26. An image forming apparatus comprising:

an image bearing member;

a rotatable charging member, forming a nip with said image bearing member, for electrically charging said image bearing member;

developing means for developing an electrostatic image formed on said image bearing member to form a toner image, said developing means supplying electroconductive particles to said image bearing member, wherein the electroconductive particles are fed to the nip by said image bearing member;

transferring means for transferring the toner image onto a recording material at a transfer position;

wherein said developing means is capable of feeding the electroconductive particles to a region of said image bearing member which corresponds to a region between a first recording material and a second recording material immediately subsequent to the first recording material, and a time period from passage of a trailing end of the first recording material through the transfer position to arrival of a leading end of the second recording material at the transfer position is variable in accordance with image information of the electrostatic image.

27. An apparatus according to claim 26, wherein the image information is indicative of an image ratio of the electrostatic image.

28. An apparatus according to claim 26, wherein the time period is increased with an image ratio.

29. An apparatus according to claim 26, wherein the time period from passage of a trailing end of the first recording material through the transfer position to arrival of a leading end of the second recording material at the transfer position is longer than a time period required for said charging member to rotate one full turn.

30. An apparatus according to claim 26, wherein said developing means is capable of feeding the electroconductive particles to said image bearing member during a developing operation of said image bearing member.

31. An apparatus according to claim 30, wherein the electroconductive particle is supplied to a non-image portion of said image bearing member.

32. An apparatus according to claim 26, wherein the electroconductive particles are charged to a polarity opposite that of a charging polarity of the toner.

33. An apparatus according to claim 26, wherein said charging member is supplied with a voltage.

34. An apparatus according to claim 26, wherein said charging member is made of a flexible member.

35. An apparatus according to claim 26, wherein said charging member is rotated with a peripheral speed difference relative to said image bearing member.

36. An apparatus according to claim 26, wherein said charging member is rotated in a direction opposite that of said image bearing member at the nip.

37. An apparatus according to claim 26, wherein said developing means is capable of collecting residual toner from said image bearing member simultaneously with a developing operation of said image bearing member.

38. An apparatus according to claim 26, wherein said charging member carries other electroconductive particles before said charging member is supplied with the electroconductive particle from said image bearing member.

39. An apparatus according to claim 26, wherein said charging member effects injection charging into said image bearing member through the nip.

40. An apparatus according to claim 26, wherein said image bearing member, said charging member and said developing means are contained in a process cartridge which is detachably mountable to a main assembly of said image forming apparatus.

* * * * *

UNITED STATES PATENT AND TRADEMARK OFFICE

CERTIFICATE OF CORRECTION

PATENT NO. : 6,801,738 B2
DATED : October 5, 2004
INVENTOR(S) : Hiroyuki Oba et al.

It is certified that error appears in the above-identified patent and that said Letters Patent is hereby corrected as shown below:

Column 1,
Line 50, "adheres" should read -- adhere --.

Column 3,
Line 39, "like)—" should read -- like); --;
Line 55, "a (first occurrence)" should be deleted; and
Line 58, "delivered," should read -- being delivered, --.

Column 4,
Line 8, "member I" should read -- member 1 --.

Column 6,
Line 44, "member I" should read -- member 1 --.
Line 53, "Member I" should read -- Member 1 --.

Column 7,
Line 15, "member I" should read -- member 1 --.

Column 8,
Line 41, "member I" should read -- member 1 --.

Column 9,
Line 1, "was" should read -- were --;
Line 4, "was" should read -- were --; and
Line 13, "NaCl," should read -- NaCl, --.

Column 10,
Line 62, "employs" should read -- employ --.

Column 11,
Lines 5, 8, 55 and 65, "member I" should read -- member 1 --;

Column 12,
Line 11, "member I" should read -- member 1 --.

UNITED STATES PATENT AND TRADEMARK OFFICE

CERTIFICATE OF CORRECTION

PATENT NO. : 6,801,738 B2
DATED : October 5, 2004
INVENTOR(S) : Hiroyuki Oba et al.

It is certified that error appears in the above-identified patent and that said Letters Patent is hereby corrected as shown below:

Column 13,
Line 19, "member I" should read -- member 1 --; and
Line 35, "fats." should read -- facts. --.

Column 14,
Line 4, "velocxty" should read -- velocity --; and
Line 7, "second:" should read -- seconds: --.

Column 15,
Line 1, "s" should read -- is --;
In Table 1, "Three full circle" should read -- Three full circles --;
Line 32, "suing" should read -- using --;
Line 37, "is" should read -- are --; and
Line 42, "mate" should read -- mately --.

Column 16,
In Table 3, "three full circle" should read -- three full circles --.

Column 17,
Line 16, "151th" should read -- 151st --; and
Line 38, "long" should read -- a long --.

Column 18,
Line 30, "<100)" should read -- ≤ 100) --.

Column 19,
Line 43, "firming" should read -- forming --.

Column 20,
Line 67, "full-him" should read -- full-turn --.

Column 21,
Line 28, "particle" should read -- particles --.

UNITED STATES PATENT AND TRADEMARK OFFICE

CERTIFICATE OF CORRECTION

PATENT NO. : 6,801,738 B2
DATED : October 5, 2004
INVENTOR(S) : Hiroyuki Oba et al.

It is certified that error appears in the above-identified patent and that said Letters Patent is hereby corrected as shown below:

Column 22,
Line 17, "full turn." should read -- full-turn. --;
Line 23, "particle is" should read -- particles are --; and
Line 45, "particle" should read -- particles, --.

Signed and Sealed this

First Day of March, 2005

JON W. DUDAS
*Director of the United States Patent and Trademark Office*